US011572781B2

(12) United States Patent
Tang et al.

(10) Patent No.: US 11,572,781 B2
(45) Date of Patent: Feb. 7, 2023

(54) ARRANGEMENT DEVICE FOR MULTIPLE SENSORS OUTSIDE BOREHOLE OF SLIDING MASS AND ARRANGEMENT METHOD

(71) Applicant: CHINA UNIVERSITY OF GEOSCIENCES (WUHAN), Wuhan (CN)

(72) Inventors: Huiming Tang, Wuhan (CN); Yongquan Zhang, Wuhan (CN); Junrong Zhang, Wuhan (CN); Changdong Li, Wuhan (CN); Xinli Hu, Wuhan (CN); Zongxing Zou, Wuhan (CN); Wenping Gong, Wuhan (CN)

(73) Assignee: CHINA UNIVERSITY OF GEOSCIENCES (WUHAN), Wuhan (CN)

( * ) Notice: Subject to any disclaimer, the term of this patent is extended or adjusted under 35 U.S.C. 154(b) by 0 days.

(21) Appl. No.: 17/401,338

(22) Filed: Aug. 13, 2021

(65) Prior Publication Data

US 2023/0008447 A1 Jan. 12, 2023

Related U.S. Application Data

(63) Continuation of application No. PCT/CN2021/107494, filed on Jul. 21, 2021.

(30) Foreign Application Priority Data

Jul. 6, 2021 (CN) ..... 202110762362.4

(51) Int. Cl.
*E21B 47/01* (2012.01)
*E21B 17/08* (2006.01)

(52) U.S. Cl.
CPC ..... *E21B 47/01* (2013.01); *E21B 17/08* (2013.01)

(58) Field of Classification Search
CPC ..... E21B 31/18; E21B 47/024; E21B 47/01; E21B 47/013; E21B 47/017; E21B 17/08; E21B 4/18
See application file for complete search history.

(56) References Cited

U.S. PATENT DOCUMENTS 7,493,954 B2 2/2009 Heller et al.
7,894,297 B2 2/2011 Nutt et al.
(Continued)

FOREIGN PATENT DOCUMENTS

CN 110736498 B * 9/2020
EP 1662225 A1 * 5/2006 ..... E21B 47/01

*Primary Examiner* — Caroline N Butcher
(74) *Attorney, Agent, or Firm* — True Shepherd LLC; Andrew C. Cheng

(57) ABSTRACT

A casing pipe extends in a vertical direction, and two adjacent casing pipes are connected by a plurality of link mechanisms; the link mechanism includes two supports, the two supports are hinged by a first pin to form a hinged portion, an upper end and a lower end of the link mechanism are hinged to two adjacent casing pipes by second pins separately, a sensor is fixed to the link mechanism, and the link mechanism has an initial state of extending in the vertical direction and an extending state in which the hinged portion extends outwards to be located on an outer side of the casing pipe; a driving mechanism drives a push portion to move towards the link mechanism; and a downward pressing apparatus is used for pressing a top end of the topmost casing pipe downwards to push the hinged portion into a side wall of the borehole.

6 Claims, 7 Drawing Sheets

(56) References Cited

U.S. PATENT DOCUMENTS

| | | | | |
|---|---|---|---|---|
| 9,279,318 | B2 | 3/2016 | Hay et al. | |
| 2011/0138903 | A1* | 6/2011 | Large | E21B 47/002 73/152.17 |
| 2016/0032717 | A1* | 2/2016 | Parker | E21B 47/12 324/369 |
| 2018/0003027 | A1* | 1/2018 | Donzier | E21B 47/01 |
| 2018/0363449 | A1* | 12/2018 | Ratcliffe | E21B 17/1021 |

* cited by examiner

ARRANGEMENT DEVICE FOR MULTIPLE SENSORS OUTSIDE BOREHOLE OF SLIDING MASS AND ARRANGEMENT METHOD

CROSS-REFERENCE TO RELATED APPLICATIONS

This application is a continuation of International Patent Application No. PCT/CN2021/107494 with a filing date of Jul. 21, 2021, designating the United States, now pending, and further claims priority to Chinese Patent Application No. 202110762362.4 with a filing date of Jul. 6, 2021. The content of the aforementioned applications, including any intervening amendments thereto, are incorporated herein by reference.

TECHNICAL FIELD

The present disclosure relates to the technical field of geological disaster monitoring and prevention, and particularly relates to an arrangement device for multiple sensors outside a borehole of a sliding mass and an arrangement method.

BACKGROUND

As a common geological hazard, the landslide hazard severely threatens our lives and property, 70% of which are large landslides that cause most major casualties and social impacts. It is crucial to construct a professional monitoring and early warning system for the landslide hazards to prevent geological hazards scientifically and actively and reduce the casualties and property losses caused by the geological hazards. As the science and technology keep progressing, technologies monitoring corresponding objects to be monitored keep upgraded, so as to provide early warning information for monitoring personnel before landslide hazards, so monitoring personnel can take engineering measures early to dispose the sliding mass emergently, and human and financial losses can be avoided.

In recent years, as for the key scientific problems about "landslide multi-field evolution and disaster-causing mechanism", for comprehensively monitoring multi-field information feature parameters of a stress field, a gravity field, a seepage field, a displacement field etc., and constructing a new system for comprehensively monitoring landslide multi-field evolution process, automatic monitoring with multi-field information feature variables combined is urgently needed, and the problems of arrangement and diverse types, low information utilization rate, low precision, low fusion degree, etc. of sensors for real-time automatic monitoring of multiple parameters of deformation, stress, temperature, hydrology, etc. are also needs to be solved. Based on that, the monitoring concept of "multi-measurement in one hole" has been introduced and drawn attention from engineering geologists. It develops into an important technical route to arrange the relevant integrated sensors in the soil mass outside the hole via the arrangement probe, but it is unclear whether the arrangement probe has enough arrangement accuracy and arrangement strength to deal with the actual underground situation in a narrow space. Therefore, it is a novel significant way to arrange the integrated sensors on the surface outside the hole. In view of this, it is of great significance to develop an efficient and reliable multi-geological information monitoring technology using "multi-measurement in one hole" in a deep position of the sliding mass.

SUMMARY

In view of this, the embodiments of the present disclosure provide an arrangement device for multiple sensors outside a borehole of a sliding mass and an arrangement method for solving the above problems.

The embodiment of the present disclosure provides an arrangement device for multiple sensors outside a borehole of a sliding mass, including:

a monitor configured to be lowered into a borehole and including a plurality of casing pipes, a plurality of link mechanisms and a sensor, where the plurality of casing pipes extend in a vertical direction and are arranged at intervals one above another, the two adjacent casing pipes are connected by the plurality of link mechanisms, and the plurality of link mechanisms are arranged at intervals in a circumferential direction of the casing pipes; and the link mechanism includes two supports, the two supports being hinged by a first pin to form a hinged portion, an upper end and a lower end of the link mechanism are hinged to the two adjacent casing pipes by second pins separately, the sensor is fixed to the link mechanism, and the link mechanism has an initial state of extending in the vertical direction and an extending state in which the hinged portion extends outwards to be located on an outer side of the casing pipe;

a monitor arrangement system including an arrangement probe, where the arrangement probe is configured to be lowered to a position, corresponding to the link mechanism, in the casing pipe and includes a driving mechanism and a plurality of push portions, the push portions corresponding to the link mechanism in a one-to-one manner, the push portions being connected with the driving mechanism, and the driving mechanism driving the push portions to move towards the link mechanism, so as to push the hinged portion into the extending state from the initial state; and a downward pressing apparatus used for pressing a top end of the topmost casing pipe downwards so as to reduce a distance between the adjacent casing pipes and push the hinged portion into a side wall of the borehole.

Further, a notch with openings on two sides may be provided in a position, corresponding to the link mechanism, of the casing pipe, the notch may be provided with a first opening and a second opening, the first opening may face the adjacent casing pipe, the second opening may face the outer side of the casing pipe, the support may be hinged to the notch by the second pin, when the link mechanism is in the initial state, the support may be located in the first opening, and when the link mechanism is in the extending state, the support may be located in the first opening and the second opening.

Further, the arrangement device for multiple sensors outside a borehole of a sliding mass may further include a locking mechanism, where the locking mechanism may include a sheet and an eccentric wheel;

one end, away from the first opening, of the sheet may be fixed into the notch, an annular boss may be fixed to the sheet, inner gear teeth may be arranged on an inner side of the annular boss, and the annular boss may be located on a periphery of the second pin; a protrusion may protrude out of a position, corresponding to the annular boss, of the support, outer gear teeth meshing with the inner gear teeth may be arranged on an outer side of the protrusion, an inner diameter of the annular boss may be larger than an outer diameter of the protrusion, and the protrusion may be located in the annular boss;

a via hole may penetrate a side wall, corresponding to the notch, of an inner side wall of the casing pipe, the eccentric wheel may be rotationally mounted on an inner side of the casing pipe, and an eccentric portion of the eccentric wheel may be located in the via hole and abut against the sheet, such that the inner gear teeth may mesh with the outer gear teeth, and a handle may be fixed to one side, away from the sheet, of the eccentric wheel and horizontally arranged in the casing pipe; and a pushing block may be arranged at a position, corresponding to the handle, of the arrangement probe, when the arrangement probe moves upwards, the pushing block may interfere with the handle to push the handle upwards, so as to rotate the eccentric wheel, and make the eccentric portion far away from the sheet.

Further, the locking mechanism may further include a partition plate, the two sheets may be located on two sides of the support separately, a base may be fixed to the inner side wall of the casing pipe and corresponding to the via hole, the eccentric wheel may be mounted on the base by a third pin, the partition plate may be located in the via hole and located between the base and the sheets, and one side, facing the sheets, of the partition plate may abut against the two sheets.

Further, wedges may be fixed to one sides, away from each other, of the two sheets and abut against side walls of the notch, wedge blocks may be arranged at positions, corresponding to the two wedges, of the partition plate, a tooth opening of the wedge may match a tooth opening of the wedge block, and a gap may be defined between the wedge block and the side wall of the notch.

Further, the arrangement probe may include a housing, a plurality of accommodating grooves extending in a radial direction of the casing pipe may be provided in the housing circumferentially, the accommodating grooves may correspond to the link mechanisms in a one-to-one manner, groove openings of the accommodating grooves may face the link mechanisms, and the pushing block may be fixed on the housing; and one end of the push portion may be located in the accommodating groove and connected to the accommodating groove by a compression spring, the other end thereof may be located outside the housing, one end, located outside the housing, of the push portion may abut against the inner side wall of the casing pipe, the compression spring may be compressed, when the arrangement probe moves upwards to a position corresponding to the link mechanism, the compression spring may push the link mechanism outwards due to an elastic recovery effect, then the hinged portion may extend outwards to the extending state, and the plurality of compression springs may constitute the driving mechanism.

Further, one end, located outside the housing, of the push portion may have a fan-shaped cross section.

Further, a ball may be embedded at an outer end of the push portion and abut against the inner side wall of the casing pipe.

Further, the arrangement device for multiple sensors outside a borehole of a sliding mass may further include a monitoring system, where the monitoring system may include a concrete pier, a communication device and a solar power supply module, the concrete pier being built on a stable ground beside the borehole, the communication device and the solar power supply module being fixed on the concrete pier, the communication device being electrically connected to the sensor to collect, preprocess and transmit monitoring data, and the solar power supply module being electrically connected to the communication device and the sensor to continuously supply power in a monitoring process.

The embodiment of the present disclosure further provides an arrangement method based on the above arrangement device for multiple sensors outside a borehole of a sliding mass and including:

S1, surveying a surface of a sliding mass, then determining a monitoring position, constructing a borehole at a preset position, and lowering a monitor into the borehole, where a link mechanism is in an initial state;

S2, using a driving device to drive a push portion to extend from the initial state to an extending state from a position below an arrangement probe to a position corresponding to the link mechanism, so as to make a hinged portion located outside a casing pipe; and S3, pressing a top end of the topmost casing pipe downwards by a downward pressing apparatus and making the hinged portion of the link mechanism continue extending outwards until two adjacent casing pipes get close to each other and are connected, where various integrated sensors fixed in a side wall of a support are pressed by static force to be embedded into a rock-soil body around the hole at the moment.

The technical solution provided in the embodiment of the present disclosure has the beneficial effects that the integrated sensors are transferred from the borehole to the outside of the borehole of the ground, so as to provide a novel arrangement method. Compared with the prior art, by increasing the selectivity of arrangement machinery, a better solution may be found for arrangement in different monitoring environments, the operation is simple, and the automation degree is high. Disturbance of a monitoring environment is reduced in a static push-in mode, an arrangement range outside the hole may be selected by selecting a support with a proper length, a monitoring range is controllable, and adaptability is higher than ever. A mode of arranging the sensor outside the hole may be better close to an original underground environment, and measures more accurate underground multi-field information of the slope. Power cables and communication cables are integrated into a flat cable outside the side wall of the casing pipe, connected to the plurality of integrated sensors and then connected to a ground monitoring system, which has high reliability and is not prone to damage.

Figure 1:
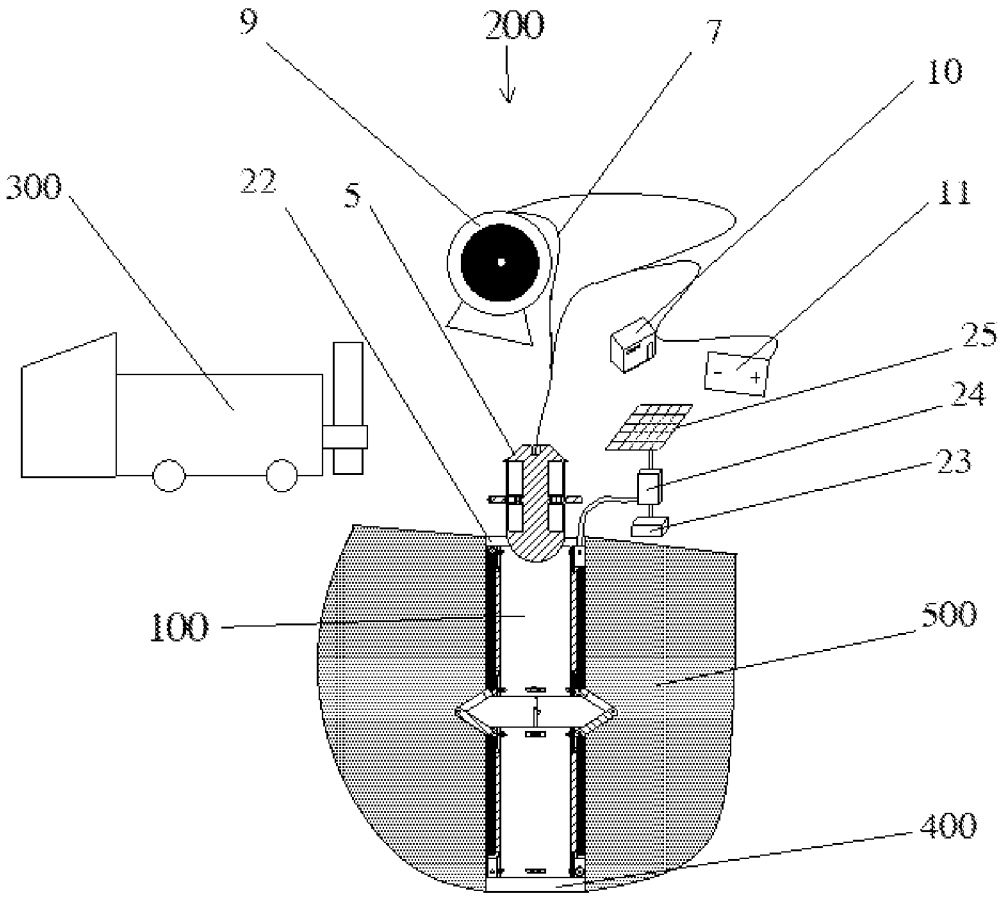
FIG. 1 is a schematic structural diagram of an embodiment of an arrangement device for multiple sensors outside a borehole of a sliding mass provided in the present disclosure.
Figure 2:
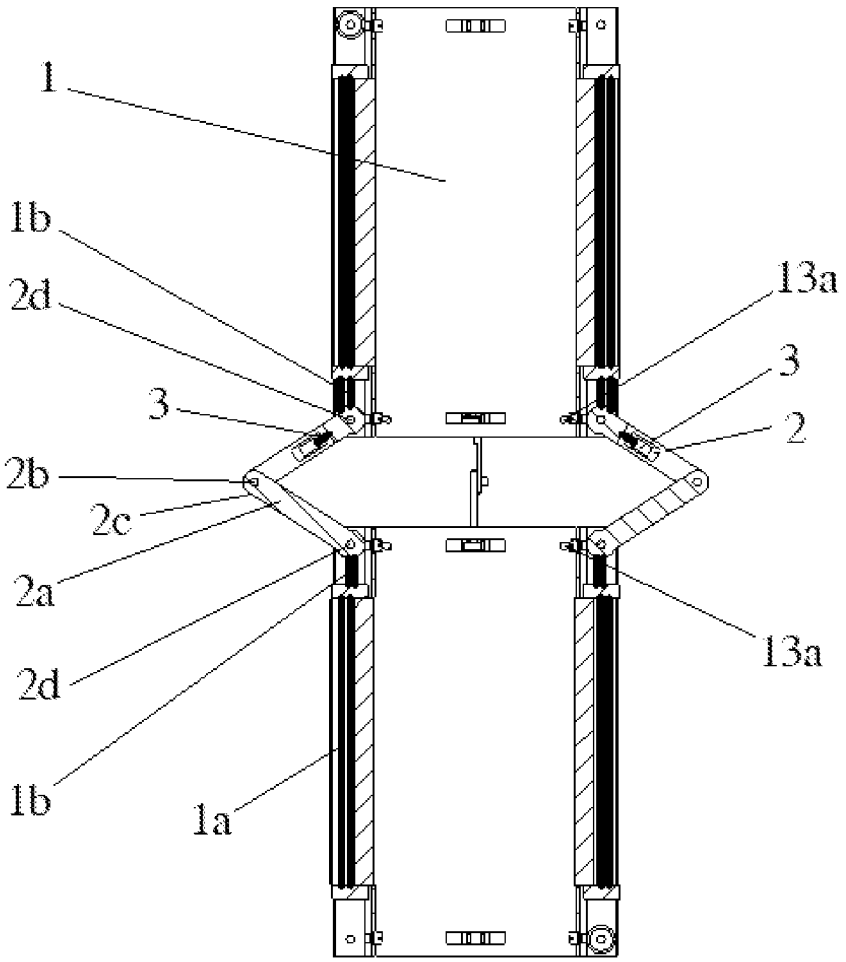
FIG. 2 is a cutaway view of a monitor (with a link mechanism in an extending state) in FIG. 1.
Figure 3:
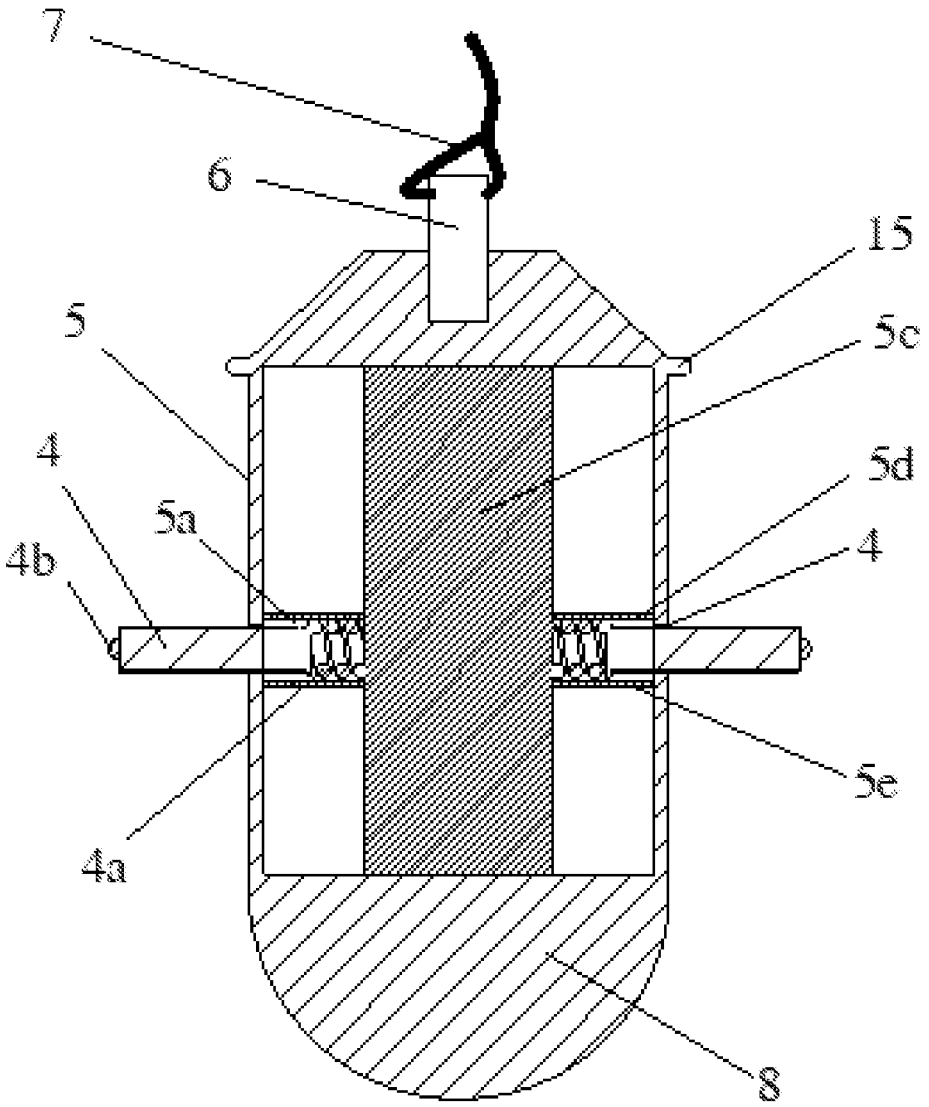
FIG. 3 is a schematic structural diagram of an arrangement probe in FIG. 1.
Figure 4:
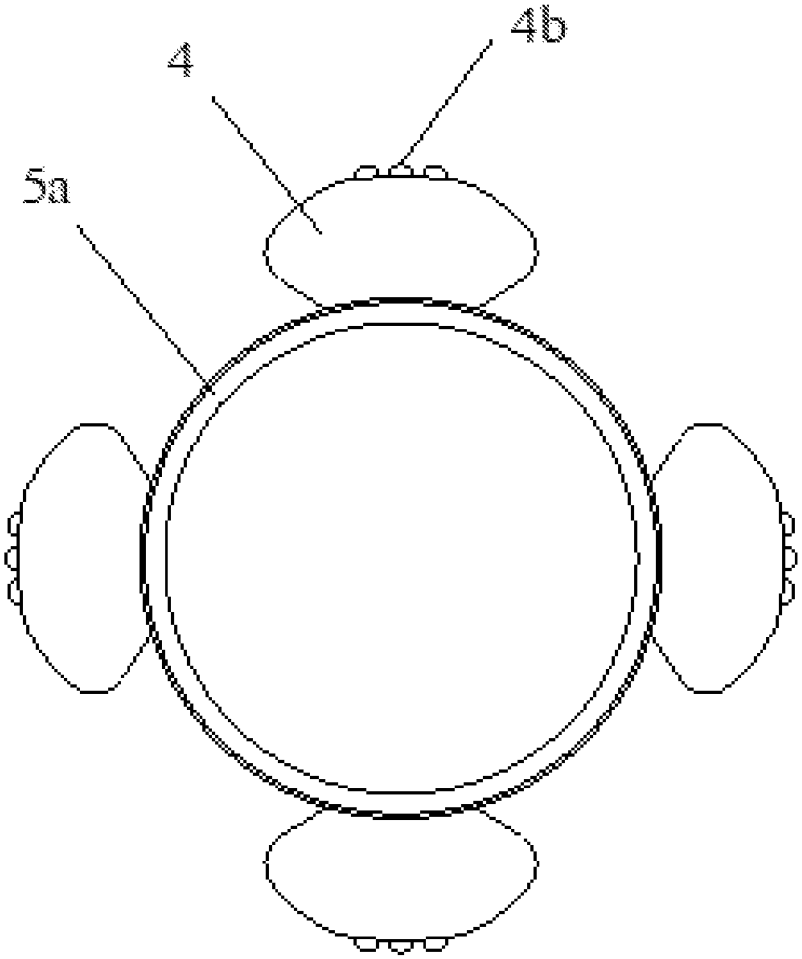
FIG. 4 is a schematic structural diagram of a housing and a push portion in FIG. 3.

In the figures: monitor 100, monitor arrangement system 200, downward pressing apparatus 300, borehole 400, sliding mass 500, casing pipe 1, guide groove 1*a*, flat cable 1*b*, notch 1*c*, first opening 1*d*, second opening 1*e*, via hole 1*f*, link mechanism 2, support 2*a*, first pin 2*b*, hinged portion 2*c*, second pin 2*d*, sensor 3, push portion 4, compression spring 4*a*, ball 4*b*, housing 5, accommodating groove 5*a*, shell 5*b*, central column 5*c*, upper limiting plate 5*d*, lower limiting plate 5*e*, pull ring 6, pull rope 7, counterweight 8, winch 9, control device 10, power supply 11, sheet 12, eccentric wheel 13, handle 13*a*, eccentric portion 13*b*, annular boss 14, pushing block 15, partition plate 16, connection plate 17, base 18, third pin 19, wedge 20, wedge block 21, cover plate 22, concrete pier 23, communication device 24, and solar power supply module 25.

DETAILED DESCRIPTION OF THE EMBODIMENTS

In order to make the objectives, technical solutions and advantages of the present disclosure clearer, the implementations of the present disclosure are described in more detail below with reference to the accompanying drawings.

With reference to FIGS. 1-6, the embodiments of the present disclosure provide an arrangement device for multiple sensors outside a borehole of a sliding mass, including a monitor 100, a monitor arrangement system 200 and a downward pressing apparatus 300.

With reference to FIG. 1, the monitor 100 is configured to be lowered into a borehole 400 and includes a plurality of casing pipes 1, a plurality of link mechanisms 2 and a sensor 3, where the plurality of casing pipes 1 extend in a vertical direction and are arranged at intervals one above another, the two adjacent casing pipes 1 are connected by the plurality of link mechanisms 2, and the plurality of link mechanisms 2 are arranged at intervals in a circumferential direction of the casing pipes 1. The link mechanism 2 includes two supports 2*a*, the two supports 2*a* being hinged by a first pin 2*b* to form a hinged portion 2*c*, an upper end and a lower end of the link mechanism 2 are hinged to the two adjacent casing pipes 1 by second pins 2*d* separately, the sensor 3 is fixed to the link mechanism 2, the link mechanism 2 has an initial state of extending in the vertical direction and an extending state in which the hinged portion 2*c* extends outwards to be located on an outer side of the casing pipe 1.

The two supports 2*a* are flat and are made of metal materials so as to be conveniently pressed and inserted into a rock-soil body on a side wall of a borehole 400, a sensor buried hole is formed in the side wall, and various integrated sensors 3 are fixed in the sensor buried hole according to monitoring requirements.

A guide groove 1*a* extending in the vertical direction is provided in an outer side wall of the casing pipe 1, an upper end of the guide groove 1*a* penetrates an upper end of the casing pipe 1, a flat cable 1*b* is embedded in the guide groove 1*a* and sealed with glue, and the flat cable 1*b* is electrically connected to the integrated sensor 3 in the sensor buried hole, so as to achieve functions of energization, control, signal transmission, etc.

The monitor arrangement system 200 includes a traction mechanism and an arrangement probe, where the arrangement probe is configured to be lowered to a position, corresponding to the link mechanism 2, in the casing pipe 1 and includes a driving mechanism and a plurality of push portions 4, the push portions 4 corresponding to the link mechanism 2 in a one-to-one manner, the push portions 4 being connected with the driving mechanism, and the driving mechanism driving the push portions 4 to move towards the link mechanism 2, so as to push the hinged portion 2*c* into the extending state from the initial state.

The downward pressing apparatus 300 is used for pressing a top end of the topmost casing pipe 1 downwards so as to reduce a distance between the adjacent casing pipes 1 and push the hinged portion 2*c* into a side wall of the borehole 400. In this embodiment, the downward pressing apparatus 300 is a static pile driver.

A notch 1*c* with openings on two sides is provided in a position, corresponding to the link mechanism 2, of the casing pipe 1, the notch 1*c* is provided with a first opening 1*d* and a second opening 1*e*, the first opening 1*d* faces the adjacent casing pipe 1, the second opening 1*e* faces the outer side of the casing pipe 1. It will be appreciated that the first opening 1*d* is arranged upwards in the notch 1*c* at the upper end of the casing pipe 1 and downwards in the notch 1*c* at the lower end of the casing pipe 1. The support 2*a* is hinged to the notch 1*c* by the second pin 2*d*, when the link mechanism 2 is in the initial state, the support 2*a* is located in the first opening 1*d*, and when the link mechanism 2 is in the extending state, the support 2*a* is located in the first opening 1*d* and the second opening 1*e*. The link mechanism 2 is located in the notch 1*c*, and the downward pressing apparatus 300 applies pressure downwards, such that two adjacent casing pipes 1 may be connected, and meanwhile damage to the link mechanism 2 caused by too large applied pressure may be avoided.

The driving mechanism only needs to apply outward thrust to the link mechanism 2, the driving mechanism may be a hydraulic air cylinder, the push portion 4 is fixedly connected to a piston rod of the hydraulic air cylinder, and the piston rod extends and retracts towards the link mechanism 2. In this embodiment, with reference to FIGS. 3-6, the arrangement probe includes a housing 5, a plurality of accommodating grooves 5*a* extending in a radial direction of the casing pipe 1 are provided in the housing 5 circumferentially, the accommodating grooves 5*a* correspond to the link mechanisms 2 in a one-to-one manner, and groove openings of the accommodating grooves 5*a* face the link mechanisms 2. In this embodiment, the accommodating grooves 5*a* are located at a same height and evenly arranged in the circumferential direction of the casing pipe 1 at intervals.

One end of the push portion 4 is located in the accommodating groove 5*a* and connected to the accommodating groove 5*a* by a compression spring 4*a*, the other end thereof may be located outside the housing 5, one end, located outside the housing 5, of the push portion 4 abuts against the inner side wall of the casing pipe 1, the compression spring 4*a* is compressed, when the arrangement probe moves upwards to a position corresponding to the link mechanism 2, the compression spring 4*a* pushes the link mechanism 2 outwards due to an elastic recovery effect, then the hinged portion 2*c* extends outwards to the extending state, and the plurality of compression springs 4*a* constitute the driving mechanism. The compression spring 4*a* has a high fatigue limit, so as to have capability of resisting fatigue damage under long-time operation and guarantee high reliability.

Specifically, the housing 5 includes a hollow shell 5*b*, a central column 5*c* is fixed to a center in the shell 5*b*, a plurality of through holes are provided in a circumferential direction of the shell 5*b* at intervals, one end of the push portion 4 is connected to the central column 5*c* by a compression spring 4*a*, the other end thereof is located outside the shell 5*b*, and the push portion 4 may move along a side wall of the through hole, thereby reducing the weight of the arrangement probe, and conveniently pulling the arrangement probe. Further, an upper limiting plate 5*d* and a lower limiting plate 5*e* are arranged on an upper side and a lower side of the compression spring 4*a*, the upper limiting plate 5*d* and the lower limiting plate 5*e* are both connected to an inner side wall of the shell 5*b* and the central column 5*c* so as to guide the push portion 4 to move, and the central column 5*c*, the upper limiting plate 5*d* and the lower limiting plate 5*e* define the accommodating groove 5*a*.

One end, located outside the housing 5, of the push portion 4 has a fan-shaped cross section so as to increase a contact area of the push portion 4 and the link mechanism 2. A ball 4*b* is embedded at an outer end of the push portion 4 and abuts against the inner side wall of the casing pipe 1, so as to reduce a friction force between the push portion 4 and the inner side wall of the casing pipe 1, and it is guaranteed that when the push portion 4 makes contact with and press the inner wall of the casing pipe 1, the arrangement probe still may freely move up and down.

Further, a pull ring 6 is welded to a top of the housing 5, a pull rope 7 is tied to the pull ring 6, and the pull rope 7 is used for pulling the arrangement probe to move up and down in the casing pipe 1. A counterweight 8 is arranged at a bottom of the housing 5, is made of stainless steel or other anti-corrosion metal and is used for making the arrangement probe keep a vertical state all the time in a process that the arrangement probe is put into the borehole 400.

With reference to FIG. 1, the traction mechanism comprises a winch 9, a control device 10 and a power supply 11. The winch 9 is connected to the pull ring 6 of the arrangement probe by the pull rope 7 and used for lowering and pulling up the arrangement probe in an arrangement stage. The power supply 11 is electrically connected to the control device 10 and the downward pressing apparatus 300 and is mainly used for supplying power to all apparatuses. The control device 10 controls a working speed, frequency, etc. of the winch 9.

Figure 5:
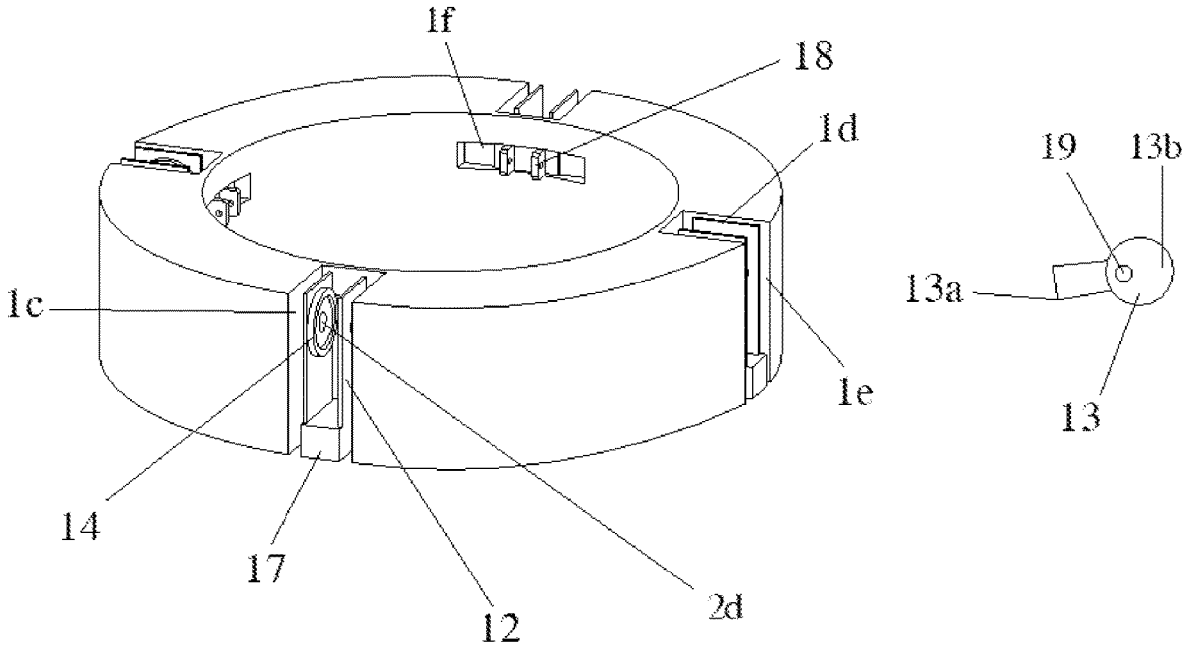
FIG. 5 is a schematic structural diagram of an end of the casing pipe in FIG. 1.
Figure 6:
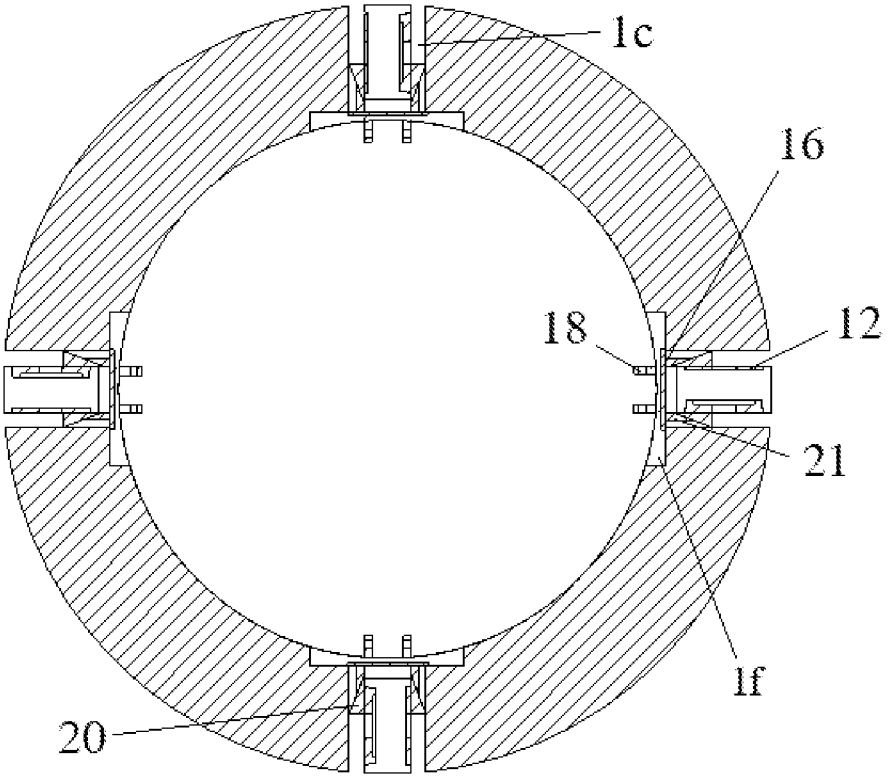
FIG. 6 is a cutaway view of the end of the casing pipe in FIG. 1.

Further, with reference to FIGS. 5 and 6, the monitor 100 further includes a locking mechanism, where the locking mechanism includes a sheet 12 and an eccentric wheel 13. The sheet 12 is made of metal, one end, away from the first opening 1*d*, of the sheet 12 is fixed into the notch 1*c*, an annular boss 14 is fixed to the sheet 12, inner gear teeth are arranged on an inner side of the annular boss 14, annular boss 14 is located on a periphery of the second pin 2*d*, the sheet 12 may be located below the second pin 2*d* or may extend to a position above the second pin 2*d*, and a receding hole is provided in a position, corresponding to the second pin 2*d*, of the sheet 12. A protrusion protrudes out of a position, corresponding to the annular boss 14, of the support 2*a*, outer gear teeth meshing with the inner gear teeth are arranged on an outer side of the protrusion, an inner diameter of the annular boss 14 is larger than an outer diameter of the protrusion, and the protrusion is located in the annular boss 14.

A via hole 1*f* penetrates a side wall, corresponding to the notch 1*c*, of an inner side wall of the casing pipe 1, the eccentric wheel 13 is rotationally mounted on an inner side of the casing pipe 1, and an eccentric portion 13*b* of the eccentric wheel 13 is located in the via hole 1*f* and abut against the sheet 12, such that the inner gear teeth mesh with the outer gear teeth, and a handle 13*a* is fixed to one side, away from the sheet 12, of the eccentric wheel 13 and horizontally arranged in the casing pipe 1.

A pushing block 15 is arranged at a position, corresponding to the handle 13*a*, of the arrangement probe. In this embodiment, the pushing block 15 is fixed on the housing 5, when the arrangement probe moves upwards, the pushing block 15 interferes with the handle 13*a* to push the handle 13*a* upwards, so as to rotate the eccentric wheel 13 and make the eccentric portion 13*b* away from the sheet 12. The eccentric wheel 13 abuts against the sheet 12, such that the inner gear teeth of the annular boss 14 on the sheet 12 mesh with the outer gear teeth protruding out of the support 2*a*, the support 2*a* may be prevented from rotating to the inner side of the casing pipe 1 and is locked, and the casing pipe 1 may be conveniently lowered into the borehole 400. The pushing block 15 is used for pushing the handle 13*a* to rotate the eccentric wheel 13, so as to make the eccentric portion 13*b* of the eccentric wheel 13 away from the sheet 12. The annular boss 14 on an inner side of the sheet 12 is separated from the protrusion on the support 2*a*, so the support 2*a* may rotate freely, and then the driving mechanism is used for driving the push portion 4 to move towards the link mechanism 2, such that it may be guaranteed that the hinged portion 2*c* of the link mechanism 2 outwards extends out of the casing pipe 1.

Further, the locking mechanism further includes a partition plate 16, the two sheets 12 are located on two sides of the support 2*a* separately, bottoms of the two sheets 12 may be connected by a connection plate 17, and the connection plate 17 is fixed in the notch 1*c*. A base 18 is fixed to the inner side wall of the casing pipe 1 and corresponding to the via hole 1*f*, the eccentric wheel 13 is mounted on the base 18 by a third pin 19, the partition plate 16 is located in the via hole 1*f* and located between the base 18 and the sheets 12, one side, facing the sheets 12, of the partition plate 16 abuts against the two sheets 12, the eccentric wheel 13 abuts against the partition plate 16 and then may abut against the sheet 12, and a situation that the eccentric wheel 13 does not correspond to the sheet 12 may be avoided.

Wedges 20 are fixed to one sides, away from each other, of the two sheets 12 and abut against side walls of the notch 1*c*, wedge blocks 21 are arranged at positions, corresponding to the two wedges 20, of the partition plate 16, a tooth opening of the wedge 20 matches a tooth opening of the wedge block 21, a gap is defined between the wedge block 21 and the side wall of the notch 1*c*, the two wedges 20 may limit the partition plate 16 and meanwhile reduce a distance between the partition plate 16 and the eccentric wheel 13, so as to facilitate mounting of the eccentric wheel 13. A width, in the circumferential direction of the casing pipe 1, of the via hole 1*f* is larger than that of the notch 1*c*, two side walls, in the circumferential direction of the casing pipe 1, of the via hole 1*f* are located on the two sides of the notch 1*c* separately, and two ends, in the circumferential direction of the casing pipe 1, of the partition plate 16 are located on the two sides of the notch 1*c* separately.

When the handle 13*a* faces the inner side of the casing pipe 1 and is horizontal, the eccentric portion 13*b* of the eccentric wheel 13 presses the partition plate 16 to make the wedge block 21 on the partition plate 16 press the wedge 20, the wedge 20 is pressed to drive the sheet 12 to be pressed, at the moment, the annular boss 14 on the inner side of the sheet 12 presses the protrusion on the support 2*a*, then the inner gear teeth of the annular boss 14 mesh with the outer gear teeth of the protrusion, and thus, the support 2*a* is locked. When the arrangement probe passes through the handle 13*a*, and the pushing block 15 interferes with the handle 13*a* to push the handle upwards, so as to rotate the handle 13*a* and make the eccentric portion 13*b* of the eccentric wheel 13 away from the partition plate 16, then the partition plate 16 is no longer pressed, accordingly, the wedge block 21 on the partition plate 16 no longer presses the wedge 20, and the annular boss 14 on the inner side of the sheet 12 is separated from the protrusion on the support 2*a*, such that the support 2*a* may rotate freely.

A cover plate 22 is arranged at the top of the casing pipe 1 and used for covering the top of the casing pipe 1 after the casing pipe 1 is arranged, so as to prevent foreign matter from falling into the casing pipe and damaging the monitoring environment in the borehole 400.

For achieving multi-geological information monitoring outside the hole, the present disclosure further includes a monitoring system, where the monitoring system includes a concrete pier 23, a communication device 24 and a solar power supply module 25. The concrete pier 23 is built on a stable ground beside the borehole 400 and is mainly used for fixing related monitoring apparatuses. The communication device 24 and the solar power supply module 25 are fixed on the concrete pier 23, the communication device 24 is electrically connected to the various integrated sensors 3 arranged in the borehole 400 by a flat cable 1*b*, and the communication device 24 may transmit data to a mobile monitoring terminal or a network by general packet radio service (GPRS) to facilitate monitoring by monitoring personnel at any time, so as to collect, preprocess and transmit the monitoring data. The solar power supply module 25 is electrically connected to the communication device 24 and various integrated sensors 3 arranged in the borehole 400 to continuously supply power in a monitoring process.

Figure 7:
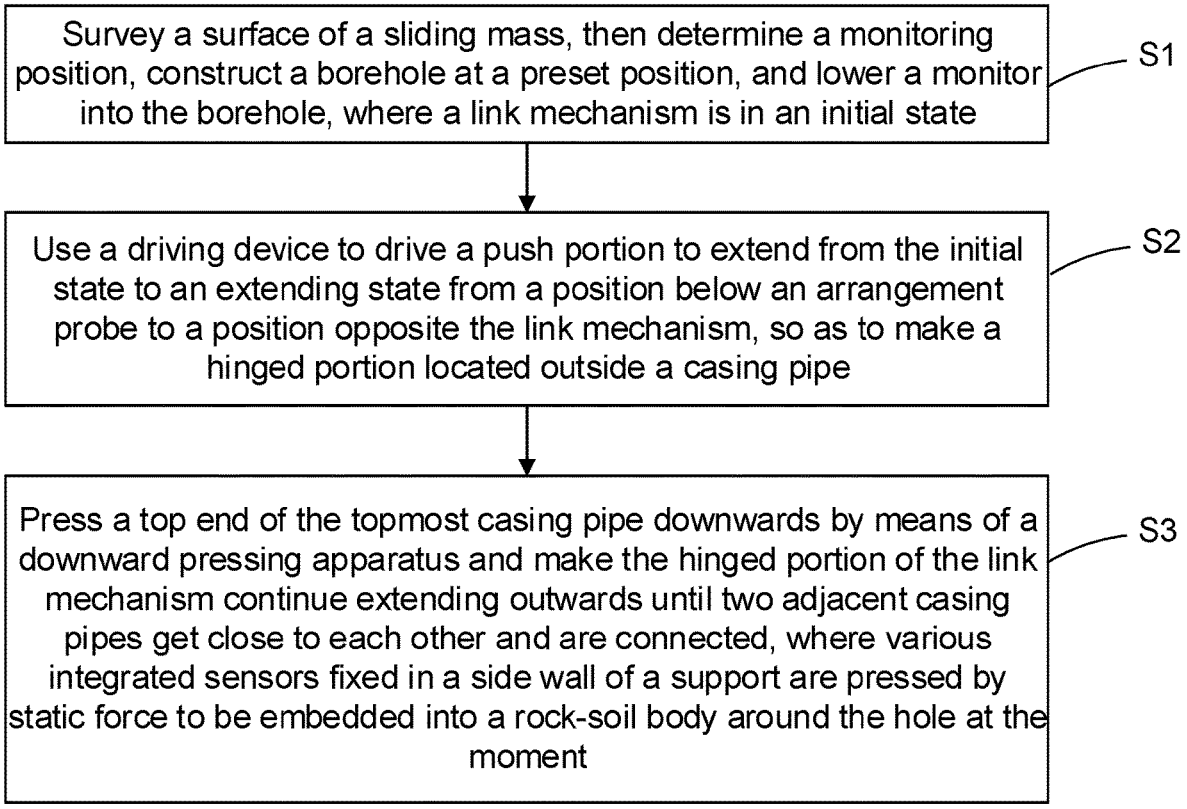
FIG. 7 is a schematic diagram of a flowchart an embodiment of an arrangement method provided in the present disclosure.

With reference FIG. 7, based on the arrangement device for multiple sensors outside a borehole of a sliding mass and the monitoring system, a surface of a sliding mass 500 is surveyed, then a monitoring position is determined, a borehole 400 is constructed at a preset position, and a monitor 100 is lowered into the borehole 400, where a link mechanism 2 is in an initial state. Specifically, the arrangement probe is pre-arranged at an inner bottom of a casing pipe 1, pulled by a pull rope 7 of a winch 9 and lowered into the borehole 400 along with the casing pipe 1, and the monitoring body 100 is lowered completely.

A driving device is used to drive a push portion 4 to extend from the initial state to an extending state from a position below an arrangement probe to a position corresponding to the link mechanism 2, so as to make a hinged portion 2*c* located outside the casing pipe 1. Specifically, the winch 9 is used for pulling the pull rope 7, the arrangement probe is lifted upwards, and the push portion 4 of the arrangement probe makes pressing contact with an inner wall of the casing pipe 1 and slides upwards under the action of a compression spring 4*a*. In a process that the arrangement probe slides upwards, a pushing block 15 firstly passes through a lower support 2*a* in a link mechanism 2, the pushing block 15 interferes with a handle 13*a* on an eccentric wheel 13, and pushes the handle 13*a* to rotate the eccentric wheel 13, and then a protrusion on the lower support 2*a* is separated from an annular boss 14 corresponding to the protrusion; and the arrangement probe continues to slide upwards, the pushing block 15 passes through the upper support 2*a* in the link mechanism 2 to interfere with the handle 13*a* on the eccentric wheel 13, and pushes the handle 13*a* to rotate the eccentric wheel 13, then the protrusion on the lower support 2*a* is separated from the annular boss 14 corresponding to the protrusion, and therefore unlocking is completed. After unlocking, the push portion 4 of the arrangement probe is corresponding to the link mechanism 2. Owing to the action of the compression spring 4*a*, the push portion 4 pushes the link mechanism 2 outwards, such that the link mechanism 2 is in an extending state in which a hinged portion 2*c* extends outwards.

The arrangement probe is pulled out of the borehole 400, then a top end of the topmost casing pipe 1 is pressed downwards by a downward pressing apparatus 300, and the hinged portion 2*c* of the link mechanism 2 continues extending outwards until two adjacent casing pipes 1 get close to each other and are connected. At the moment, various integrated sensors 3 fixed in a side wall of the support 2*a* are pressed by static force to be embedded into a rock-soil body around the hole.

A flat cable 1*b* in a guide groove 1*a* is electrically connected to a communication device 24 and a solar power supply module 25, and a cover plate 22 covers the top of the casing pipe 1, so as to monitor a deep portion of a sliding mass 500.

In the technical solution provided in the present disclosure, the integrated sensors 3 are transferred from the borehole 400 to the outside of the borehole 400 of the ground, so as to provide a novel arrangement method. Compared with the prior art, by increasing the selectivity of arrangement machinery, a better solution may be found for arrangement in different monitoring environments, the operation is simple, and the automation degree is high. Disturbance of a monitoring environment is reduced in a static push-in mode, an arrangement range outside the hole may be selected by selecting a support 2*a* with a proper length, a monitoring range is controllable, and adaptability is higher than ever. A mode of arranging the sensor 3 outside the hole may be better close to an original underground environment, and measures more accurate underground multi-field information of the slope. Power cables and communication cables are integrated into a flat cable 1*b* outside the side wall of the casing pipe 1, connected to the plurality of integrated sensors 3 and then connected to a ground monitoring system, which has high reliability and is not prone to damage.

Herein, the involved terms front, rear, upper, lower, etc., are defined in terms of the positions of parts and between the parts in the drawings, just for clarity and convenience of expressing the technical solution. It should be understood that the use of such parties should not limit the scope of protection of the claimed application.

The above embodiments and the features of the embodiments herein may be combined with each other without conflict.

The above embodiment is merely a preferred embodiment of the present disclosure but not intended to limit the present disclosure, and any modifications, equivalent replacements, improvements, etc. made within the spirit and principles of the present disclosure shall fall within the scope of protection of the present disclosure.

What is claimed is:

1. An arrangement device for multiple sensors outside a borehole of a sliding mass, comprising:

a monitor configured to be lowered into a borehole and comprising a plurality of casing pipes, a plurality of link mechanisms and a sensor, wherein the plurality of casing pipes extend in a vertical direction and are arranged at intervals one above another, two adjacent casing pipes are connected by the plurality of link mechanisms, and the plurality of link mechanisms are arranged at intervals in a circumferential direction of the casing pipes; and each link mechanism comprises two supports, the two supports being hinged by a first pin to form a hinged portion, an upper end and a lower end of the link mechanism are hinged to the two adjacent casing pipes by second pins separately, the sensor is fixed to the link mechanism, and the link mechanism has an initial state of extending in the vertical direction and an extending state in which the hinged portion extends outwards to be located on an outer side of the casing pipe;

a monitor arrangement system comprising an arrangement probe, wherein the arrangement probe is configured to be lowered to a position, corresponding to the link mechanism, in the casing pipe and comprises a driving mechanism and a plurality of push portions, the plurality of push portions corresponding to the plurality of link mechanisms in a one-to-one manner, the plurality of push portions being connected to the driving mechanism, and the driving mechanism driving the plurality of push portions to move towards the link mechanism, so as to push the hinged portion into the extending state from the initial state;

a downward pressing apparatus used for pressing a top end of a topmost casing pipe downwards so as to reduce a distance between the adjacent casing pipes and push the hinged portion into a side wall of the borehole; wherein a notch with openings on two sides is provided in a position, corresponding to the link mechanism, of the casing pipe, the notch is provided with a first opening and a second opening, the first opening faces an adjacent casing pipe, the second opening faces the outer side of the casing pipe, each of the two supports is hinged to the notch by the second pin, when the link mechanism is in the initial state, the two supports are located in the first opening, and when the link mechanism is in the extending state, the two supports are located in the first opening and the second opening; and a locking mechanism, wherein the locking mechanism comprises a sheet and an eccentric wheel;

one end, away from the first opening, of the sheet is fixed into the notch, an annular boss is fixed to the sheet, inner gear teeth are arranged on an inner side of the annular boss, and the annular boss is located on a periphery of the second pin; a protrusion protrudes out of a position, corresponding to the annular boss, of the support, outer gear teeth meshing with the inner gear teeth are arranged on an outer side of the protrusion, an inner diameter of the annular boss is larger than an outer diameter of the protrusion, and the protrusion is located in the annular boss;

a via hole penetrates a side wall, corresponding to the notch, of an inner side wall of the casing pipe, the eccentric wheel is rotationally mounted on an inner side of the casing pipe, and an eccentric portion of the eccentric wheel is located in the via hole and abuts against the sheet, such that the inner gear teeth mesh with the outer gear teeth, and a handle is fixed to one side, away from the sheet, of the eccentric wheel and horizontally arranged in the casing pipe; and a pushing block is arranged at a position, corresponding to the handle, of the arrangement probe, when the arrangement probe moves upwards, the pushing block interferes with the handle to push the handle upwards, so as to rotate the eccentric wheel and make the eccentric portion away from the sheet.

2. The arrangement device according to claim 1, wherein the arrangement probe comprises a housing, a plurality of accommodating grooves extending in a radial direction of the casing pipe are provided in the housing circumferentially, the plurality of accommodating grooves correspond to the plurality of link mechanisms in a one-to-one manner, groove openings of the plurality of accommodating grooves face the plurality of link mechanisms, and the pushing block is fixed on the housing; and one end of the plurality of push portions is located in the plurality of accommodating grooves and connected to the plurality of accommodating grooves by a compression spring, the other end thereof is located outside the housing, one end, located outside the housing, of the plurality of push portions abuts against the inner side wall of the casing pipe, the compression spring is compressed, when the arrangement probe moves upwards to a position corresponding to the link mechanism, the compression spring pushes the link mechanism outwards due to an elastic recovery effect, then the hinged portion extends outwards to the extending state, and the plurality of compression springs constitute the driving mechanism.

3. The arrangement device according to claim 2, wherein one end, located outside the housing, of the plurality of push portions has a fan-shaped cross section.

4. The arrangement device according to claim 2, wherein a ball is embedded at an outer end of the plurality of push portions and abuts against the inner side wall of the casing pipe.

5. The arrangement device according to claim 1, further comprising a monitoring system, wherein the monitoring system comprises a concrete pier, a communication device and a solar power supply module, the concrete pier being built on a stable ground beside the borehole, the communication device and the solar power supply module being fixed on the concrete pier, the communication device being electrically connected to the sensor to collect, preprocess and transmit monitoring data, and the solar power supply module being electrically connected to the communication device and the sensor to continuously supply power in a monitoring process.

6. An arrangement method, based on the arrangement device for multiple sensors outside a borehole of a sliding mass according to claim 1 and comprising:

S1, surveying a surface of a sliding mass, then determining a monitoring position, constructing a borehole at a preset position, and lowering the monitor into the borehole, wherein the plurality of link mechanisms are in an initial state;

S2, lowing the arrangement probe to a position corresponding to the plurality of link mechanisms, and using a driving mechanism to drive the plurality of push portions to extend from the initial state to an extending state, so as to extending the hinged portion outside the casing pipe; and S3, pressing a top end of the topmost casing pipe downwards by the downward pressing apparatus and making the hinged portion of the plurality of link mechanisms continue extending outwards until two adjacent casing pipes get close to each other and are connected, wherein the multiple sensors fixed in a side wall of a support are pressed by static force to be embedded into a rock-soil body around the hole at the moment.

* * * * *